US011751658B2

(12) United States Patent
Fang et al.

(10) Patent No.: US 11,751,658 B2
(45) Date of Patent: Sep. 12, 2023

(54) HAIR DRYER

(71) Applicant: ZHEJIANG YUELI ELECTRICAL CO., LTD., Zhejiang Province (CN)

(72) Inventors: Guohong Fang, Zhejiang Province (CN); Guojun Shen, Zhejiang Province (CN)

( * ) Notice: Subject to any disclaimer, the term of this patent is extended or adjusted under 35 U.S.C. 154(b) by 431 days.

(21) Appl. No.: 17/136,901

(22) Filed: Dec. 29, 2020

(65) Prior Publication Data

US 2022/0125176 A1 Apr. 28, 2022

(30) Foreign Application Priority Data

Oct. 28, 2020 (CN) ..... 202011173960.X

(51) Int. Cl.
*A45D 20/12* (2006.01)

(52) U.S. Cl.
CPC ..... *A45D 20/122* (2013.01); *A45D 2200/202* (2013.01)

(58) Field of Classification Search
CPC ..... A45D 20/122; A45D 2200/202
USPC ..... 34/283, 95–100
See application file for complete search history.

(56) References Cited

U.S. PATENT DOCUMENTS 1,976,509 A * 10/1934 Olsen ..... A45D 20/22 34/100
6,601,316 B2 * 8/2003 Shaw, II ..... A45D 20/12 34/96
7,428,785 B2 * 9/2008 Kim ..... A45D 20/10 219/222
10,021,952 B2 * 7/2018 Goldman ..... F26B 21/001
10,342,311 B2 * 7/2019 Yue ..... G01J 5/025
2022/0125176 A1 * 4/2022 Fang ..... A45D 20/42
2022/0378166 A1 * 12/2022 Ceva ..... A45D 20/12
2023/0122821 A1 * 4/2023 Nie ..... H01H 3/12 34/96

FOREIGN PATENT DOCUMENTS

EP 4115765 A1 * 1/2023 ..... A45D 20/10
KR 20220141873 A * 10/2022
WO WO-0213652 A1 * 2/2002 ..... A45D 20/10
WO WO-2021223689 A1 * 11/2021 ..... A45D 20/10

* cited by examiner

*Primary Examiner* — Stephen M Gravini
(74) *Attorney, Agent, or Firm* — Clement Cheng

(57) ABSTRACT

The invention discloses a hair dryer. The hair dryer comprises: a body, an installation cavity is provided in an interior of the body, a blowing mechanism is provided in an interior of the installation cavity; an annular inner air intake net, disposed at a tail end of the body; a plurality of perforative inner air inlets, formed on a circumferential surface of the annular inner air intake net; an annular air intake net cover, detachably sleeved on an outer side of the annular inner air intake net; a plurality of perforative outer air inlets being formed on a circumferential surface of the annular air intake net cover, wherein the plurality of outer air inlets communicate with the plurality of inner air inlets; porous fillers, arranged between the annular inner air intake net and the annular air intake net cover.

9 Claims, 5 Drawing Sheets

HAIR DRYER

BACKGROUND OF THE INVENTION

1. Field of the Invention

The invention relates to the technical field of household appliances, and more particularly, to a hair dryer.

2. Description of the Related Art

Various problems are associated with these commercially available hair dryers in the prior art. In particular, due to the fact that the conventional hair dryer is designed to draw air from the outside from its trailing end, tiny impurities contained in the air may have an impact on a blowing mechanism provided in an interior of the hair dryer. In addition, since an inlet has a flow-through design, airflow swirl may be generated in the tail end of the hair dryer, which in turn leads to loud noise during its operation. Furthermore, user experience is lowered. For users having long hair, it is easy to introduce their long hair into the interior of the hair dryer through the air inlet, which puts users' safety at risk.

SUMMARY OF THE INVENTION

Given that the foregoing problems exist in the prior art, the present invention provides a hair dryer. By adopting the proposed hair dryer, sufficient inflow of air is obtained, noise volume is reduced, and the safety of users can be ensured.

The technical solution is as follows:

a hair dryer comprising:

a body, an installation cavity being provided in an interior of the body, a blowing mechanism being provided in an interior of the installation cavity;

an annular inner air intake net disposed at a tail end of the body, a plurality of perforative inner air inlets being formed on a circumferential surface of the annular inner air intake net;

an annular air intake net cover, detachably sleeved on an outer side of the annular inner air intake net, a plurality of perforative outer air inlets being formed on a circumferential surface of the annular air intake net cover, the plurality of outer air inlets communicating with the plurality of inner air inlets;

porous fillers, arranged between the annular inner air intake net and the annular air intake net cover, wherein one side of the porous fillers is opposite to the plurality of inner air inlets, and the other side of the porous fillers is opposite to the plurality of outer air inlets.

The above-mentioned hair dryer has a further feature that a first tail-end magnetic attraction structure is provided on a side of the annular air intake net cover, a second tail-end magnetic attraction structure is provided on a tail end of the body, and the first tail-end magnetic attraction structure and the second tail-end magnetic attraction structure can either attract or repel each other.

The above-mentioned hair dryer has a further feature that the blowing mechanism is located at a middle portion of the installation cavity, adjacent to the annular air intake net cover.

The above-mentioned hair dryer has a further feature that it further comprises a driving circuit board, the driving circuit board is positioned adjacent to the blowing mechanism, the driving circuit board is communicatively connected to the blowing mechanism, and a side of the driving circuit is opposite to a side of the porous fillers.

The above-mentioned hair dryer has a further feature that it further comprises an anion generator and an anion emitting head, wherein the anion generator is provided on a side of the blowing mechanism close to a head end of the body, the anion emitting head is provided at the head end of the body, and the anion generator is opposite to the anion emitting head.

The above-mentioned hair dryer has a further feature that it further comprises a double-layer nozzle, the double-layer nozzle is detachably arranged on the head end of the body, the double-layer nozzle comprises an inner layer nozzle and an outer layer nozzle nested with each other, and a gap forms between the inner layer nozzle and the outer layer nozzle.

The above-mentioned hair dryer has a further feature that one side of the double-layer nozzle is provided with a first head-end magnetic attraction structure, the head end of the body is provided with a second head-end magnetic attraction structure, and the first head-end magnetic attraction structure and the second head-end magnetic attraction structure can either attract or repel each other.

The above-mentioned hair dryer has a further feature that each of the plurality of inner air inlets has a diameter that is no smaller than that of each of the plurality of the outer air inlets.

The above-mentioned hair dryer has a further feature that a handle is provided on an extension of a side of the body, the cold air button is provided on the handle;

a heating device control loop is disposed inside of the body, the cold air button is disposed in the heating device control loop;

short press the cold air button to switch on and switch off the heating device control loop; and long press the cold air button to switch off the heating device control loop, long press and release the cold air button to switch on the heating device control loop.

The above-mentioned hair dryer has a further feature that the heating device control loop comprises a timer, the cold air button is in contact connection with the timer, and the timer starts to work when the cold air button is pressed or touched;

when the time, as calculated by the timer, for the action of press or touch on the cold air button, is less than or equal to a preset time, it is a short press;

and when the time, as calculated by the timer, for the action of press or touch on the cold air button, is greater than the preset time, it is a long press.

By adopting the above-mentioned technical solutions, the present invention has the beneficial effects that: a hair dryer provided in the present invention is provided with an annular air intake net cover and an annular inner air intake net; in addition, porous fillers are arranged between inner air inlets and outer air inlets of the annular air intake net cover and the annular inner air intake net. As a result, sufficient inflow of air is obtained, noise produced by the hair dryer is reduced, and hair can be prevented from being drawn into the hair dryer, so that the safety of users can be ensured. The annular air intake net cover and a double-layer nozzle are magnetic attraction detachable device, thereby, it is easy to clean and replace. The use of a double-layer nozzle prevents users from being burned while in use. A driving circuit board is disposed adjacent to a blowing mechanism and the annular inner air intake net, so that the internal structure of the hair dryer can more compact, and excellent heat dissipation can be achieved. An anion generator and an anion emitting head are arranged that the number of anions emitting from the anion generator is increased. Short press and long press on the cold air button makes the operation simplified, so as to satisfy different users.

BRIEF DESCRIPTION OF THE DRAWINGS

The accompanying drawings, together with the specification, illustrate exemplary embodiments of the present disclosure, and, together with the description, serve to explain the principles of the present invention.

Figure 1:
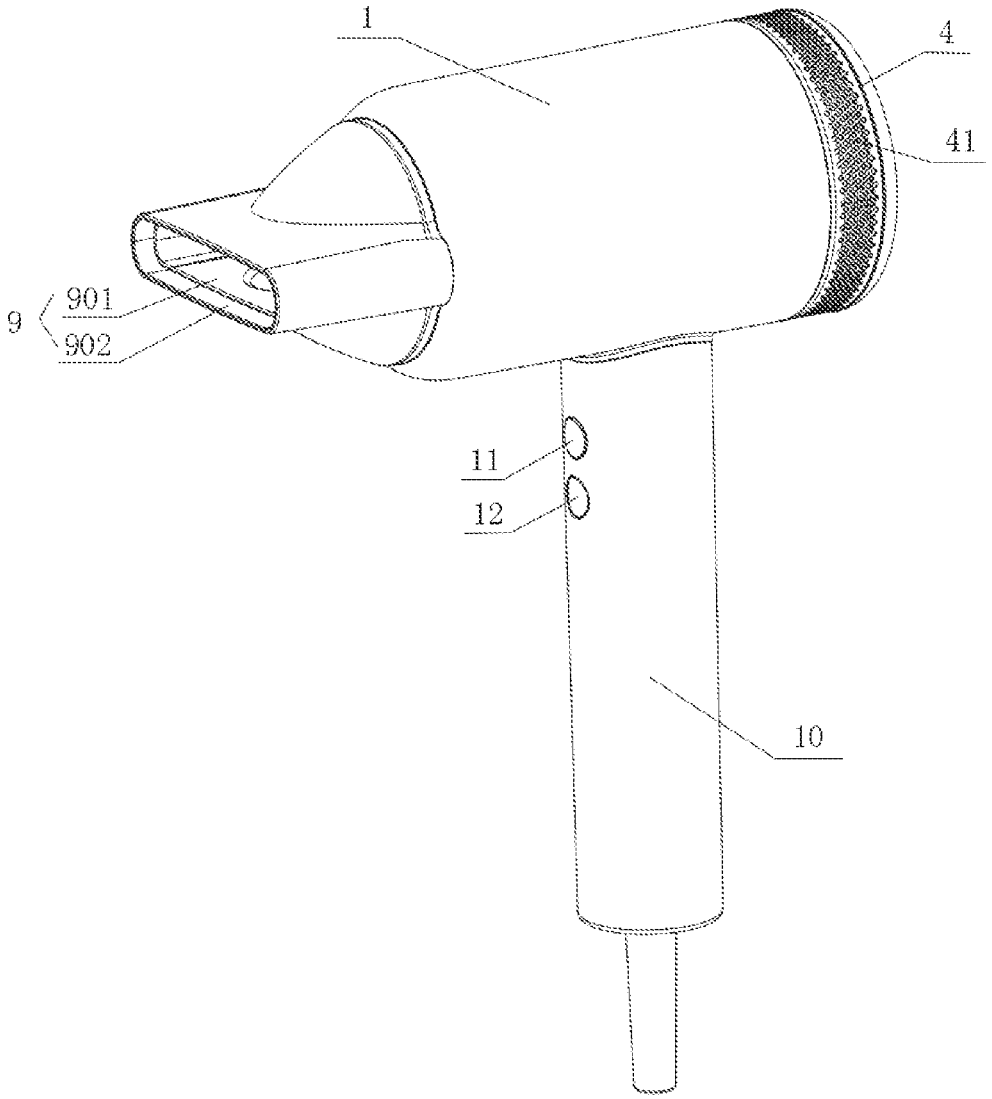
FIG. 1 is a perspective view of an embodiment of a hair dryer according to the present invention.

In the accompanying drawings: 1. body; 101. installation cavity; 2. blowing mechanism; 3. annular inner air intake net; 4. annular air intake net cover; 41. outer air inlets; 5. porous fillers; 6. driving circuit board; 7. anion generator; 8. anion emitting head; 9. double-layer nozzle; 901. inner layer nozzle; 902. outer layer nozzle; 10. handle; 11. cold air button; 12. power button.

DETAILED DESCRIPTION

In order to make technical solutions, inventive features, objects and advantages of the present invention easy to understand, a hair dryer provided in the present invention is illustrated from the following detailed description of preferred embodiments, along with FIGS. 1 to 5.

The ordinal terms "first", "second" and the like as used herein are used for distinguishing between similar elements and not necessarily for describing a sequence or implying any technical priorities. As used herein, and unless the context dictates otherwise, the terms "connected to", "coupled to" are intended to include both direct connecting (coupling) and indirect connecting (coupling). It is to be understood that the terms "above", "below", "front", "back", "left", "right", "vertical", "horizontal". "top", "bottom", "inner", "outer", "clockwise", "anticlockwise" and the like in the description and the claims are orientation and position relations as indicated in the drawings, and those terms are used for descriptive purposes and not necessarily implying that the described devices or elements must have particular orientations, or must be constructed or operated in the specific orientations, thus, it should not be understood those terms are not intended as being limiting of the present invention.

In the present invention, unless otherwise stated, the first feature is above or below the second feature may mean that the first feature and the second feature are in direct contact with each other, or the first feature and the second feature are in indirect contact with each other via a medium. Moreover, the first feature is over and above the second feature may means that the first feature is right above the second feature or above the second feature, or it just means that the first feature is higher than the second feature. The first feature is under and below the second feature may mean that the first feature is right below the second feature or below the second feature, or it just means that the first feature is lower than the second feature.

In the hair dryer, an installation cavity 101 is provided in an interior of the body 1 of the hair dryer. The installation cavity 101 runs across a head end and a tail end of the body 1. Generally, the installation cavity 101 is substantially an elongated airflow passage through which air flows. A blowing mechanism 2 is provided in an interior of the installation cavity 101 for forming a negative pressure in the installation cavity 101, so that external air is sucked into the installation cavity 101 from the tail end of the body 1. In particular, the blowing mechanism 2 can be a motor. Preferably, the motor is a high-speed digital motor, so as to provide a relatively strong wind for the hair dryer.

The annular inner air intake net 3 is disposed at the tail end of the body 1. In particular, the annular inner air intake net 3 comprises an annular circumferential surface and a round bottom surface. The round bottom surface is of a closed design. A plurality of perforative inner air inlets are formed on the circumferential surface of the annular inner air intake net 3. The plurality of inner air inlets communicate with the installation cavity 101. The external air passes through the inner air inlets to enter into the installation cavity 101. The use of the annular inner air intake net 3 ensures a sufficient inflow of air while providing protection against heat damage.

An annular air intake net cover 4 is detachably sleeved on an outer side of the annular inner air intake net 3. The annular air intake net cover 4 needs to be removed from the annular inner air intake net 3 after it has been used for a period of time so as to clean out debris sucked into the hair dryer. In particular, the annular air intake net cover 4 also comprises an annular circumferential surface and a round bottom surface. The round bottom surface of the annular air intake net cover 4 is parallel to that of the annular inner air intake net 3. A plurality of perforative outer air inlets 41 in an annular array are formed on the circumferential surface of the annular air intake net cover 4, the plurality of outer air inlets 41 communicate with the plurality of inner air inlets. The plurality of outer air inlets 41 are disposed parallel to the plurality of inner air inlets, so that external impurities, such as dust and fibers, can be prevented from entering the installation cavity without affecting the efficiency of air entering the hair dryer. In the meantime, the outer air inlets 41 and the inner air inlets arranged in an annular array can ensure a sufficient inflow of air, however, the sucked air may not generate airflow swirl. Therefore, noise generated by the air can be effectively reduced, and the hair dryer is quieter during operation.

Porous fillers 5 are arranged between the annular inner air intake net 3 and the annular air intake net cover 4. Specifically, the porous fillers 5 are open-cell sponges and are arranged in an annular shape. Air may pass through the interior of the porous fillers 5. The presence of the porous fillers 5 may filter air, and prevent dust, fibers, cotton wools and other impurities from entering the interior of the hair dryer, preventing damage to the interior of the hair dryer while preventing hair from being sucked into the hair dryer. Accordingly, user's personal safety is guaranteed. Furthermore, one side of the porous fillers 5 is opposite to the plurality of inner air inlets, and the other side of the porous fillers is opposite to the plurality of outer air inlets. The porous fillers 5 are provided such that a part of the noise can be absorbed, thus, the noise is reduced.

Figure 3:
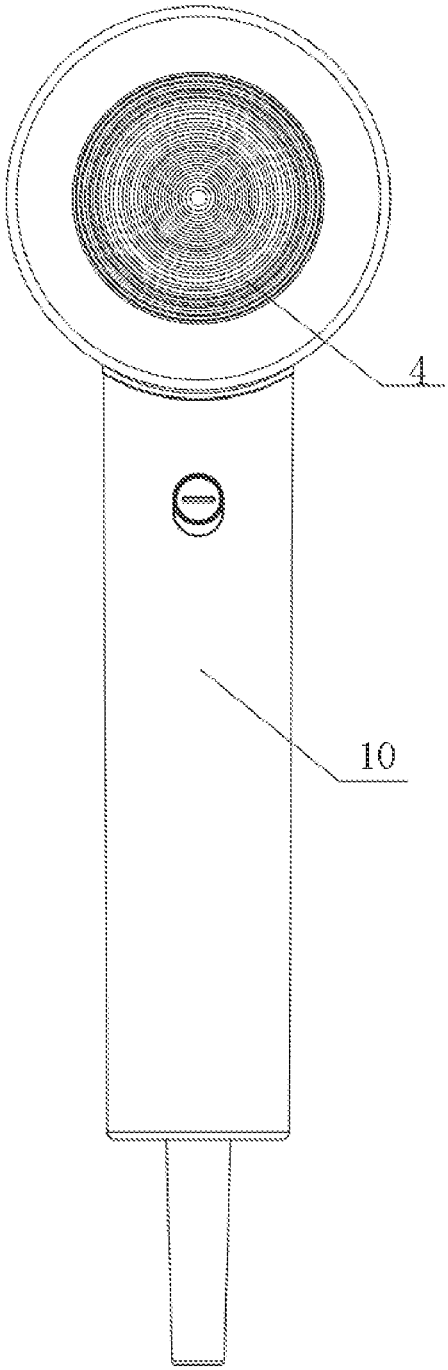
FIG. 3 is a second side view of an embodiment of a hair dryer according to the present invention.
Figure 4:
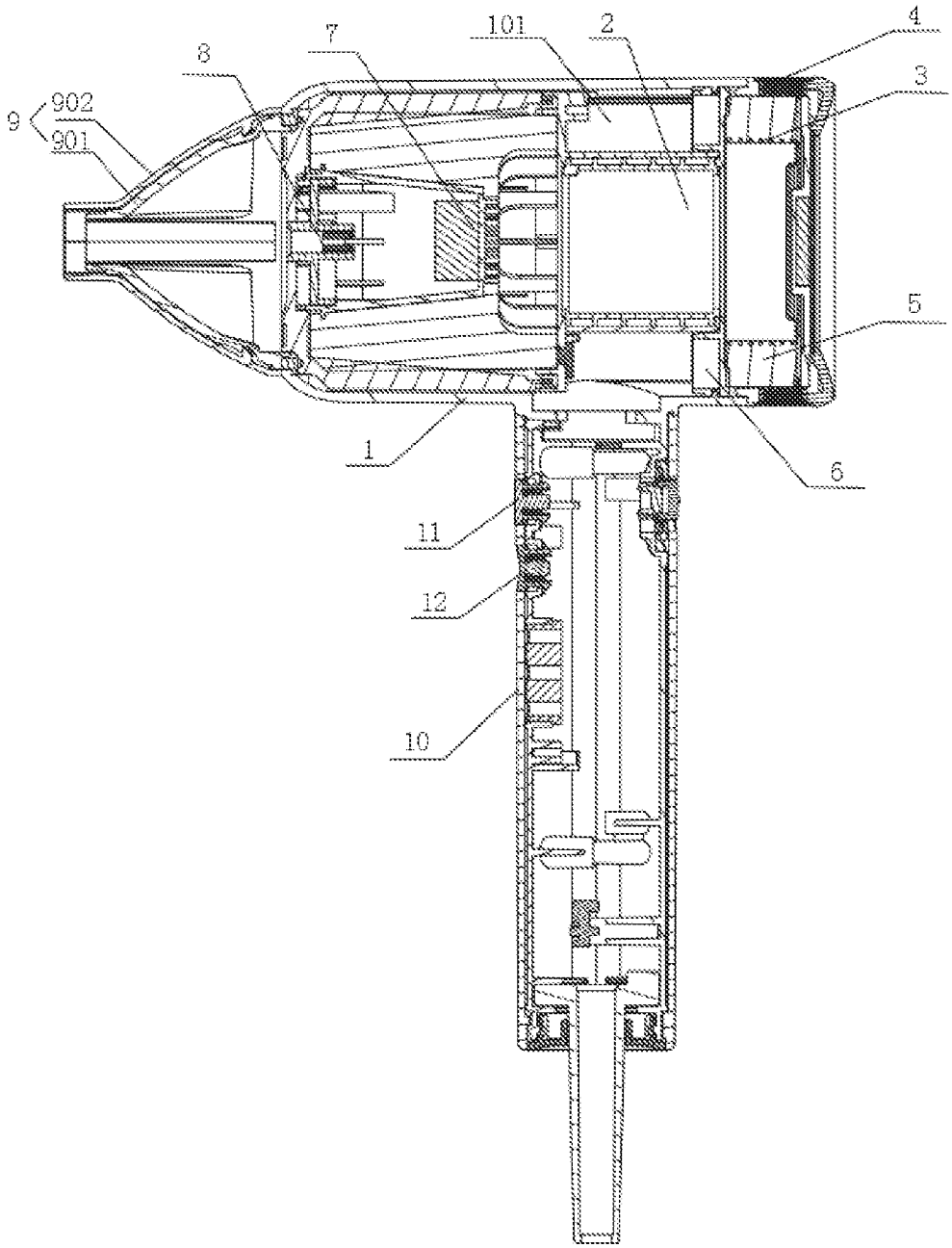
FIG. 4 is a cross-sectional view of an embodiment of a hair dryer according to the present invention.

In a preferred embodiment, as shown in FIGS. 1, 3, and 4, a first tail-end magnetic attraction structure (not shown in the figures) is provided on a side of the annular air intake net cover 4, a second tail-end magnetic attraction structure (not shown in the figures) is provided on a tail end of the body 1, and the first tail-end magnetic attraction structure and the second tail-end magnetic attraction structure can either attract or repel each other. In particular, the first tail-end magnetic attraction structure and the second tail-end magnetic attraction structure can be magnets with different polarities. Alternatively, one of the first tail-end magnetic attraction structure and the second tail-end magnetic attraction structure is a magnet, and the other is a magnetic metal (e.g., iron, cobalt, nickel), so that they can attract and repel each other.

Furthermore, the first tail-end magnetic attraction structure may be a protrusion or a clamping groove, and the second tail-end magnetic attraction structure may be a clamping groove or a protrusion. The protrusion may be snapped into the clamping groove. The clamping groove has an "L"-shaped longitudinal section. The annular air intake net cover 4 is assembled to the body 1 of the hair dryer by subsequent attraction. In addition, the protrusion is separated from the clamping groove so as to separate the annular air intake net cover 4 from the body 1.

In a preferred embodiment, as shown in FIG. 4, the blowing mechanism 2 is located at a middle portion of the installation cavity 101, adjacent to the annular air intake net cover 3. Generally, the blowing mechanism 2 is a motor. A tail portion of the motor corresponds to the circumferential surface of the annular air intake net cover 3, allowing a source of negative pressure generated by the motor close to the annular air intake net cover 3, and increasing the wind strength of the hair dryer.

In a preferred embodiment, as shown in FIG. 4, the hair dryer further comprises a driving circuit board 6. The driving circuit board 6 is positioned adjacent to the blowing mechanism 2, such that the internal space of the body 1 is saved a lot, its internal structure is more compact, and the volume of the hair dryer is reduced. The driving circuit board 6 is communicatively connected to the blowing mechanism 2. The driving circuit board 6 is used to control the normal operation of the blowing mechanism 2, that is, the motor. Furthermore, a side of the driving circuit 6 is opposite to a side of the porous fillers 5, such that the driving circuit board 6 is close to the annular inner air intake net 3. In this way, it is beneficial to achieve good hear dissipation. Otherwise, the driving circuit board 6 may be damaged due to its excessive heat.

In a preferred embodiment, as shown in FIG. 4, the hair dryer further comprises an anion generator 7 and an anion emitting head 8. In particular, the anion generator 7 and the anion emitting head 8 are electrically connected to the external power supply. The anion generator 7 is provided on a side of the blowing mechanism 2 close to the head end of the body 1 for continuously generating anions; and the anion emitting head 8 is provided on the head end of the body 1. The anion emitting head 8 assists in guiding anions out of the body 1. The anion generator 7 is opposite to the anion emitting head 8.

Furthermore, the anion generator 7 is spaced from the anion emitting head 8 by a distance. The anion generator 7 is electrically connected to the anion emitting head 8. A sharp tip of the anion emitting head 8 is oriented towards the air outlet of the hair dryer. The direct current or alternating current is processed into direct current negative high voltage by the anion generator 7, and the direct negative high voltage is connected to the anion emitting head 8. The tip DC high voltage of the anion emitting head 8 generates a high corona and releases a large number of electrons. The released electrons are captured by oxygen molecules in the air, then anions are generated. The tip of the anion emitting head 8 faces toward the air outlet of the hair dryer. The anion generator 7 transmits the anions to the airflow passage through the anion emitting head 8. The anions may quickly diffuse to an air outlet of the airflow passage under the action of strong negative electric field, and form a negative voltage around the anion emitting head 8. In this way, unionized air is continuously poured into the periphery of the anion emitting head 8. The unionized air is continuously blown to hair though the airflow passage, so that positive charge in the hair is neutralized, making the hair softer and shiny. In addition, with the help of the double-layer nozzle 9, the generated anions are made to be concentrated in a small range, so that the utility ratio of the anions is improved.

Figure 2:
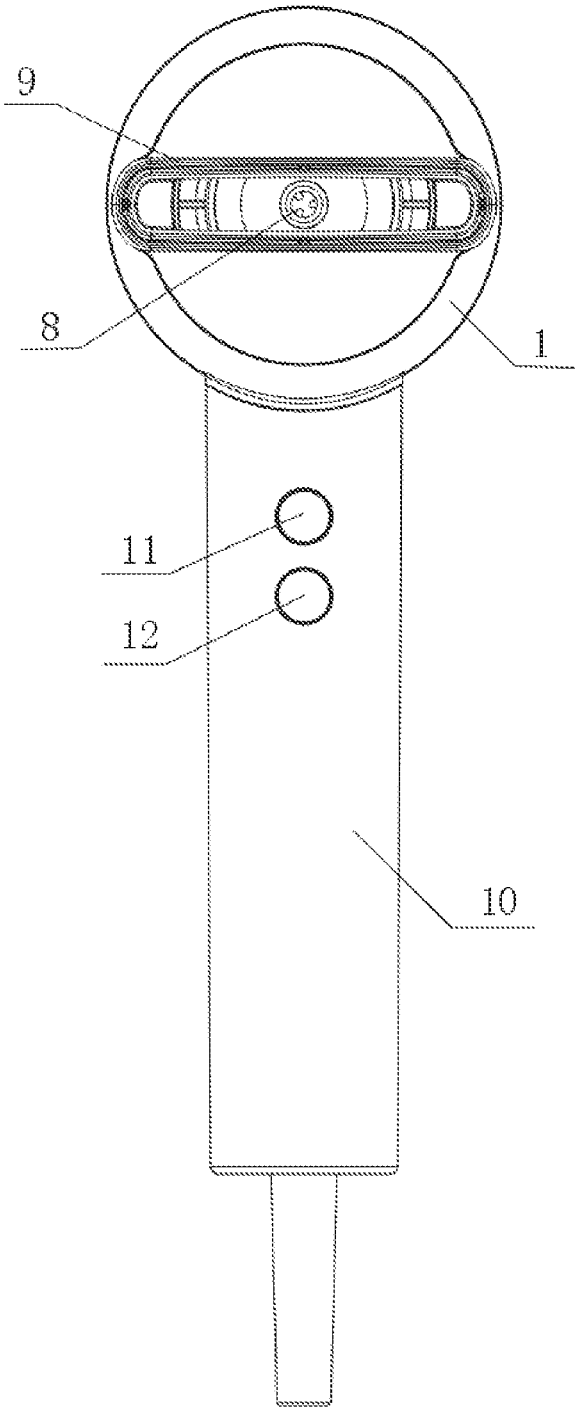
FIG. 2 is a first side view of an embodiment of a hair dryer according to the present invention.

In a preferred embodiment, as shown in FIGS. 1, 2 and 4, the hair dryer comprises a double-layer nozzle 9, the double-layer nozzle 9 is detachably attached to the head end of the body 1, the double-layer nozzle 9 comprises an inner layer nozzle 901 and an outer layer nozzle 902 nested with each other. The inner layer nozzle 901 and the outer layer nozzle 902 are provided with a waist-shaped hole, and a gap forms between the inner layer nozzle and the outer layer nozzle. Air may pass through the gap, so that it can stop transferring heat from the inner layer nozzle 901 to the outer layer nozzle 902, thus temperature of the outer layer nozzle 902 is effectively reduced, and users can be prevented from being burned during the use of the hair dryer.

In a preferred embodiment, as shown in FIGS. 1 and 4, a first head-end magnetic attraction structure (not shown in the figures) is provided on a side of the double-layer nozzle 9, a second head-end magnetic attraction structure (not shown in the figures) is provided on a head end of the body 1, and the first head-end magnetic attraction structure and the second head-end magnetic attraction structure can either attract or repel each other. In particular, the first head-end magnetic attraction structure and the second head-end magnetic attraction structure may be magnets with different polarities. Alternatively, one of the first head-end magnetic attraction structure and the second head-end magnetic attraction structure is a magnet, and the other is a magnetic metal (e.g., iron, cobalt, nickel), so that they can attract and repel each other. In addition, the double-layer nozzle 9 has many shapes and patterns so as to satisfy requirements for different hair styles. It is advantageous to have such a magnetic attraction structure in terms of easy disassembly and replacement.

Furthermore, the first head-end magnetic attraction structure may be a protrusion or a clamping groove, and the second head-end magnetic attraction structure may be a clamping groove or a protrusion. The protrusion may be snapped into the clamping groove. The clamping groove has an "L"-shaped longitudinal section. The double-layer nozzle is assembled to the body of the hair dryer by subsequent attraction. In addition, the protrusion is separated from the clamping groove so as to separate the double-layer nozzle from the body.

Figure 5:
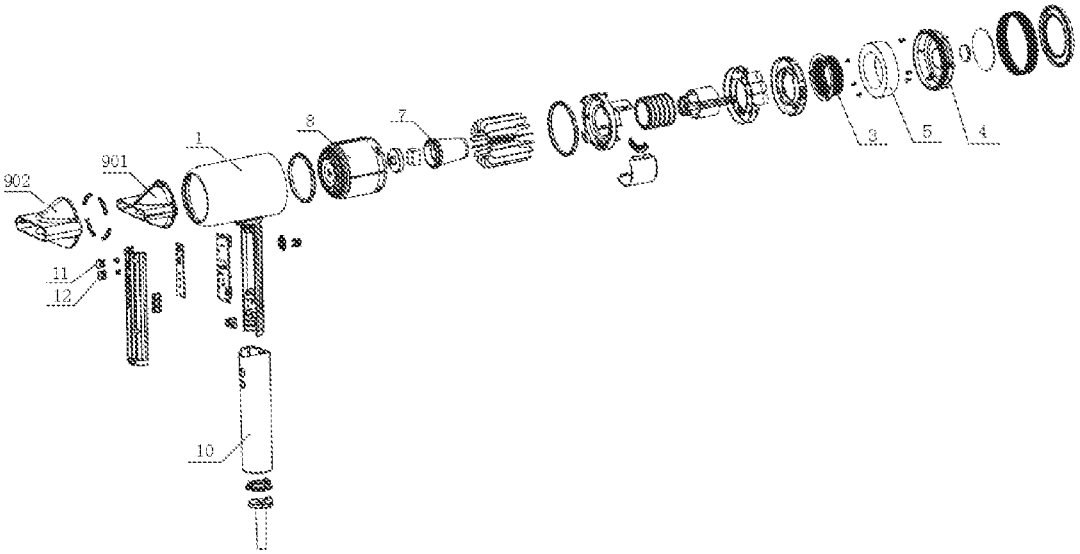
FIG. 5 is an exploded view of an embodiment of a hair dryer according to the present invention.

In a preferred embodiment, as shown in FIGS. 3, 4, and 5, each of the plurality of inner air inlets has a diameter that is no smaller than that of each of the plurality of the outer air inlets, however, total areas of the plurality of the outer air inlets are greater than those of the plurality of the inner air inlets. In particular, smaller outer air inlets may help prevent parts of external dust and impurities from entering the hair dryer, and larger inner air inlets may help resist the resistance of wind, so that the volume of air entering the hair dryer per unit time is increased. Thereby, it can increase the wind intensity of the hair dryer while reducing the amount of larger impurities entering the body 1 of the hair dryer.

In a preferred embodiment, as shown in FIGS. 1, 2, and 4, the hair dryer further comprises a cold air button 11. A handle 10 is provided on an extension of a side of the body 1, the cold air button 11 is provided on the handle 10. The old air button 11 is configured to control a switch of a heating device (not shown in the figures) of the body 1. The handle is typically provided with a power button 12 for controlling a switch of the blowing mechanism 2, that is, the motor of the hair dryer.

A heating device control loop is disposed inside of the body 1, and the cold air button 11 is disposed in the heating device control loop. In particular, the cold air button 11 is configured to control the switch on and switch off of the heating device control loop, that is, press or touch the cold air button 11 to switch on or switch off the heating device. Specifically, the heating device may be a heating wire provided in the installation cavity, adjacent to the blowing mechanism 2, so that air sucked into the hair dryer may be heated.

Short press the cold air button 11 to switch on and switch off the heating device control loop; and Long press the cold air button 11 to switch off the heating device control loop, long press and release the cold air button 11 to switch on the heating device control loop.

In particular, the hair dryer comprises a controller. The controller may be a single-chip microcomputer. The controller mainly controls three control loops, namely, a first control loop, a second control loop, and a third control loop. The first control loop (i.e., the heating device control loop) is connected to the heating device, and the second control loop and the third control loop are connected to common resistors. The first control loop and the second control loop are switched when the user short presses the cold air button 11. When the first control loop is switched on, the second control loop is switched off. The heating device is working normally, the hair dryer blows hot air. Short press the cold air button, the first control loop is switched off and the second control loop is switched on, the heating device stops working, and the hair dryer blows cold air. If the user long presses the cold air button, the controller switches off the first control loop and the second control loop, and switches on the third control loop. Since the third control loop is not provided with the heating device, the hair dryer still blows cold air. When the user long presses the cold air button 11 and releases the button thereafter, the third control loop is switched off. The controller switches on the first control loop again, and the second control loop is still switched off, so that the hair dryer is readjusted to blow hot air. Short press the cold air button 11 again may switch between the hot air and the cold air.

In a preferred embodiment, as shown in FIG. 4, the beating device control loop comprises a timer (not shown in the figure), the cold air button 11 is in contact connection with the timer, and the timer starts to work when the cold air button 11 is pressed or touched.

When the time, as calculated by the timer, for the action of press or touch on the cold air button 11, is less than or equal to a preset time (e.g, the preset time may be 1.5 S), it is a short press. When the timer determines that it is a short press, a first electrical signal is output, one of the first control loop and the second control loop is switched on, and the third control loop is switched off.

When the time, as calculated by the timer, for the action of press or touch on the cold air button 11, is greater than a preset time (e.g, the preset time may be 1.5 S), it is a long press. When the timer determines that it is a long press, a second electrical signal is output, both the first control loop and the second control loop are switched off and the third control loop is switched on.

In particular, the third control loop comprises a NOT gate.

Various technical features in the above-mentioned embodiments can be combined in any way. All the possible combinations of the technical features of the embodiments are not described for the simplicity of the invention. However, all the combinations of the technical features are considered to be within the scope of the present invention as long as they do not conflict with each other.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A hair dryer comprising:

a body, an installation cavity being provided in an interior of the body, a blowing mechanism being provided in an interior of the installation cavity;

an annular inner air intake net disposed at a tail end of the body, a plurality of perforative inner air inlets being formed on a circumferential surface of the annular inner air intake net;

an annular air intake net cover, detachably sleeved on an outer side of the annular inner air intake net, a plurality of perforative outer air inlets being formed on a circumferential surface of the annular air intake net cover, the plurality of outer air inlets communicating with the plurality of inner air inlets;

porous fillers, arranged between the annular inner air intake net and the annular air intake net cover, wherein one side of the porous fillers is opposite to the plurality of inner air inlets, and another side of the porous fillers is opposite to the plurality of outer air inlets;

further comprising: a cold air button, wherein a handle is provided on an extension of a side of the body, the cold air button is provided on the handle;

a heating device control loop is disposed inside of the body, the cold air button is disposed in the heating device control loop;

short press the cold air button to switch on and switch off the heating device control loop; and long press the cold air button to switch off the heating device control loop, long press and release the cold air button to switch on the heating device control loop.

2. The hair dryer of claim 1, wherein a first tail-end magnetic attraction structure is provided on a side of the annular air intake net cover, a second tail-end magnetic attraction structure is provided on a tail end of the body, and the first tail-end magnetic attraction structure and the second tail-end magnetic attraction structure can either attract or repel each other.

3. The hair dryer of claim 1, wherein the blowing mechanism is located at a middle portion of the installation cavity, adjacent to the annular air intake net cover.

4. The hair dryer of claim 1, further comprising: a driving circuit board, the driving circuit board is positioned adjacent to the blowing mechanism, the driving circuit board is communicatively connected to the blowing mechanism, and a side of the driving circuit is opposite to a side of the porous fillers.

5. The hair dryer of claim 1, further comprising: an anion generator and an anion emitting head, wherein the anion generator is provided on a side of the blowing mechanism close to a head end of the body, the anion emitting head is provided at the head end of the body, and the anion generator is opposite to the anion emitting head.

6. The hair dryer of claim 1, further comprising: a double-layer nozzle, the double-layer nozzle is detachably arranged on a head end of the body, the double-layer nozzle comprises an inner layer nozzle and an outer layer nozzle nested with each other, and a gap forms between the inner layer nozzle and the outer layer nozzle.

7. The hair dryer of claim 6, wherein one side of the double-layer nozzle is provided with a first head-end magnetic attraction structure, the head end of the body is provided with a second head-end magnetic attraction structure, and the first head-end magnetic attraction structure and the second head-end magnetic attraction structure can either attract or repel each other.

8. The hair dryer of claim 1, wherein each of the plurality of inner air inlets has a diameter that is no smaller than that of each of the plurality of the outer air inlets.

9. The hair dryer of claim 1, wherein the heating device control loop comprises a timer, the cold air button is in contact connection with the timer, and the timer starts to work when the cold air button is pressed or touched;

when a time, as calculated by the timer, for the action of press or touch on the cold air button, is less than or equal to a preset time, it is a short press;

and when a time, as calculated by the timer, for the action of press or touch on the cold air button, is greater than the preset time, it is a long press.

* * * * *